United States Patent [19]

Chern

[11] 4,307,739

[45] Dec. 29, 1981

[54] HYGIENIC COMB AND BRUSH

[76] Inventor: Horng Y. Chern, 10-4 Fl., No. 62, Chang Chun Rd., Taipei, Taiwan

[21] Appl. No.: 152,836

[22] Filed: May 27, 1980

[51] Int. Cl.[3] ..... A45D 44/18

[52] U.S. Cl. ..... 132/85

[58] Field of Search ..... 132/9, 85; 15/87, 98, 15/97 A, 222

[56] References Cited

U.S. PATENT DOCUMENTS

| | | | |
|---|---|---|---|
| 3,818,916 | 6/1974 | Meyer | 132/85 |
| 3,833,008 | 9/1974 | Brackett | 132/85 |
| 4,226,251 | 10/1980 | Wall | 132/85 |

*Primary Examiner*—Robert A. Hafer

*Attorney, Agent, or Firm*—Cushman, Darby & Cushman

[57] ABSTRACT

A hygienic comb and brush in which a plurality of thin film layers are removably held atop each other on the comb base with the bristles extending through the layers so that the bristles can be cleaned by removing a film.

6 Claims, 6 Drawing Figures

HYGIENIC COMB AND BRUSH

BACKGROUND OF THE INVENTION

The conventional comb or brush will accumulate hair or dust on the comb teeth or brush bristles after being used for a time. To cleanse or wash the comb or brush by hand will cause inconvenience and may contaminate user's fingers or may introduce bacteria.

One new developed comb available in the market is shown in FIG. 6. Such a comb has teeth back B pivotedly connected to a grating handle H' so that said handle may be raised to the position shown in dotted line to withdraw hair or dust from the comb teeth. Each grate G of grating handle H' must be made in parallel to allow each tooth to pass through each grate freely. The parallel teeth will lose their opportunity to cross hairs so that its combing efficiency will be poorer than that of general combs having divergent or flaring teeth. Meanwhile, each grate G may still accumulate some hair or dust. The hair removed by said grating handle must still be removed by hand and contamination can result.

The present inventor has found these defects and invented present hygienic comb and brush.

SUMMARY OF THE INVENTION

One object of the present invention is to provide a hygienic comb and brush which comprises several layers of thin film adhered on the back or handle so that each thin film may be subsequently torn off to remove the hair or dust collected on the comb teeth or brush bristles.

BRIEF DESCRIPTION OF THE DRAWING

(FIG 1*a* is an illustration of comb derived from FIG. 1.)

DESCRIPTION OF THE PREFERRED EMBODIMENTS

Figure 1:
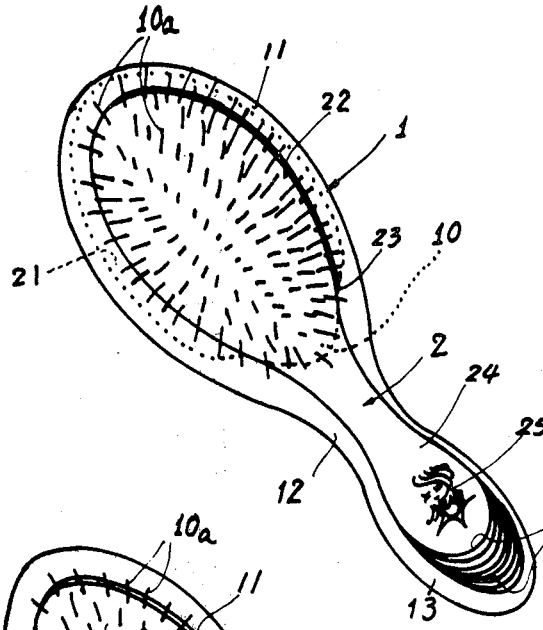
FIG. 1 is a perspective drawing of comb in accordance with the present invention.
Figure 2:
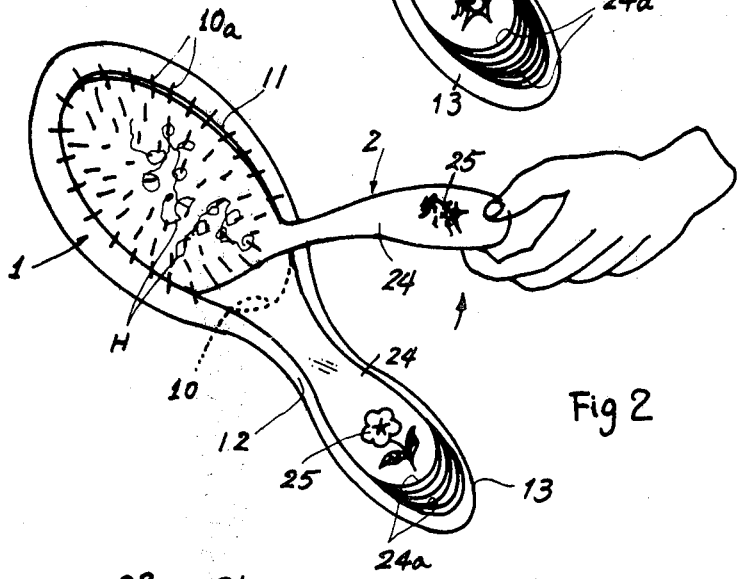
FIG. 2 is an application illustration of tearing the thin film on said comb.
Figure 3:
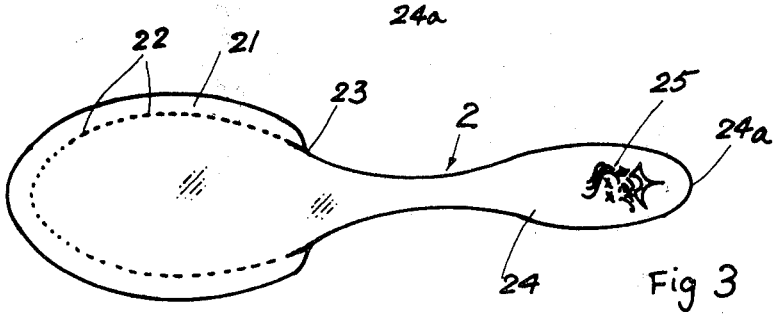
FIG. 3 is a top view drawing of said thin film.

As shown in FIGS. 1, 2 and 3, a comb of one preferred embodiment of the present invention is illustrated. Said comb 1 is adhered with several layers of thin film 2 on the rubber-made teeth base 10 of the comb back.

Said thin film 2 may be made from plastic film, cotton cloth, paper, rubber sheet or plastic net. A pressure-sensitive adhesive is coated on the back of each thin film 2. An extended edge 21 is formed on the thin film 2 at a position corresponding to the circumference of rim 11 along the back of said comb 1. A perforation line 22 is provided along the edge 21 of said thin film 2. Said edge 21 and perforation 22 end at the position numbered 23 near the neck portion 12 of said comb 1. Said thin film 2 is extended from point 23 to form a narrow slip 24 having arcuated end 24*a*. Each film 2 is formed with a releasing surface within the perforation line 22 and the slip 24 thereof. However, the edge 21 outside the perforation 22 is formed as a rough upper surface for easier adhesion from layer to layer.

Several layers of thin film 2 are adhered onto the back and handle of said comb 1 in that the film except the slip 24 is adhered onto the teeth bed 10 and the edge 21 is adhered under the rim 11 of said comb 1 so that the perforation line 22 is projectively coincided with the inner edge of rim 11 of said comb 1. Beginning at point 23, said film 2 is withdrawn and extended to form a slip 24 which is adhered on the narrow neck 12 and handle 13. Each film may be printed with a different decorative figure 25. The number of layers of thin film may be preferably 5 to 15 and may be adjusted depending upon the actual requirement. The end 24*a* of each slip 24 should not be overlapped. That is, the end 24*a* of the upper film should be slightly shorter than its lower one as shown for easier removing of film 2.

After using said comb for a time, the upper film may be torn as shown in FIG. 2 to remove the hair or dust H accumulated on the comb teeth 10*a*. By holding the slip end 24*a* and tearing the film 2, it is easily torn to point 23. From that point the tearing force is acting at the perforation line 22 and the edge 21 is bound to the edge of teeth bed 10 so that the film within said perforation 22 will then be easily released to reveal the new surface of another film 2 with fresh figure 25 shown. All the hairs or dust H are rolled into film 2 which may be disposed without contaminating one's fingers.

Figure 4:
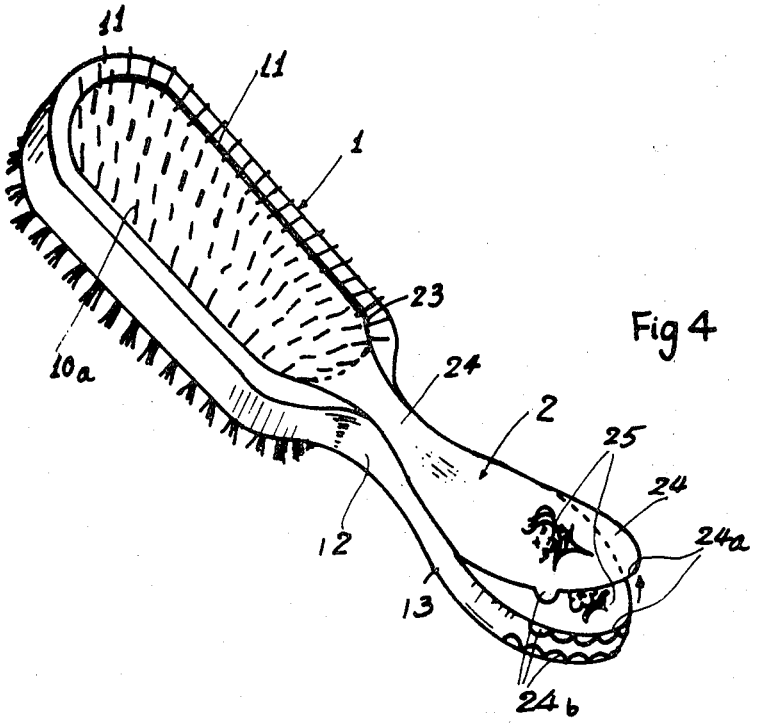
FIG. 4 is a perspective drawing of another preferred embodiment of the present invention.

Another embodiment of the present invention is shown in FIG. 4. The instrument is a dual type of comb and brush. By using the similar method as foregoing mentioned, each face is respectively coated with thin film 2. The slip end 24*a* may be further formed with a round tip 24*b* which is bent to adhere on the handle edge as shown. Each film may be formed with the same slip.

Figure 5:
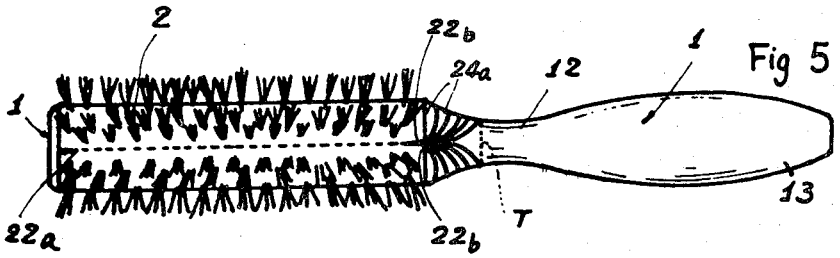
FIG. 5 is a perspective drawing of further preferred embodiment of the present invention.
Figure 6:
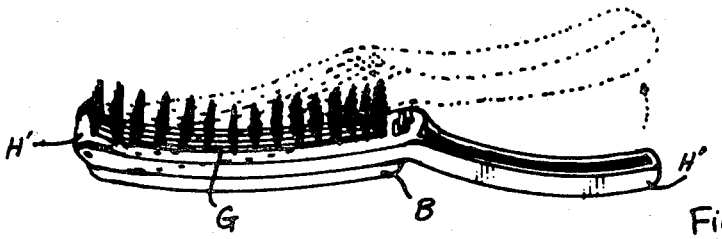
FIG. 6 is an illustration of conventional comb having parallel teeth.

The present invention may be further illustrated with a flare type brush as shown in FIG. 5. Said brush 1 may also be adhered with several layers of thin film 2. However, each thin film 2 is formed around the round bar of said brush 1. Both sides of each film after being wound to cover the brush bar will form a boundary line which is located at the opposite side of perforation line 22*a*. Such a perforation line 22*a* is provided centrally on each film 2. Beginning at point 22*b*, each film 2 is tapered to form two arcuated slip ends 24*a* which are respectively extended between boundary layer and perforation line 22*a*. All the slip ends are adhered on the neck portion 12 and are covered with a trademark label for new product sales.

The present invention may be made with divergent teeth or bristles so as to facilitate dressing, cleansing and combing when using such an instrument. After collecting the hairs or dusts around the teeth or bristles, the thin film 2 may be torn to remove the dirty material without contamination. The new surface with new figure present will also furnish the freshness and decorative purpose.

As shown in FIG. 1*a*, the comb 1 may be inserted with several layers of thin film 2 without coating adhesive on film back. A movable frame 1*a* having front opening 1*b* is engaged within the rim 11 and 13*a* so as to stop said film 2 within said comb 1. This will save the coating of adhesive.

I claim:

1. A hygienic comb and brush comprising a base having a teeth bed portion with plurality of bristles extending upwardly therefrom and a handle portion;

a plurality of thin film layers removably held atop each other on said base with said bristles extending through said layers, each of said layers each having a perforation line inward from its edge and extending about the periphery of the bristles and each layer extending over said handle portion so that the uppermost layer can be removed by pulling on the portion extending over said handle.

2. A comb and brush as in claim 1 wherein said layers are each printed with a different design.

3. A comb and brush as in claim 1 or 2 wherein said layers each extend to a different length on said handle.

4. A comb and brush as in claim 1 or 2 wherein said layers have an adhesive on one side thereof.

5. A comb and brush as in claim 1 or 2 wherein the portion of each said layer between said edge and perforations have a rough upper surface.

6. A comb and brush as in claim 1 or 2 wherein said base is a round bar with the layers extending thereabout to meet at a boundary line.

* * * * *